US012631193B2

(12) United States Patent
Yu et al.

(10) Patent No.: US 12,631,193 B2
(45) Date of Patent: May 19, 2026

(54) AXIAL FLOW WIND WHEEL, AIR CONDITIONER OUTDOOR UNIT, AND AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Dongdong Yu, Foshan (CN); Naitong Liu, Foshan (CN); Yuefei Li, Foshan (CN); Zhenjiang Zhan, Foshan (CN); Jinghui Feng, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefel (CN)

( * ) Notice: Subject to any disclaimer, the term of this patent is extended or adjusted under 35 U.S.C. 154(b) by 186 days.

(21) Appl. No.: 18/563,926

(22) PCT Filed: Apr. 19, 2022

(86) PCT No.: PCT/CN2022/087749
§ 371 (c)(1),
(2) Date: Nov. 24, 2023

(87) PCT Pub. No.: WO2023/015931
PCT Pub. Date: Feb. 16, 2023

(65) Prior Publication Data

US 2025/0084865 A1 Mar. 13, 2025

(30) Foreign Application Priority Data

Aug. 7, 2021 (CN) ..... 202121838268.4

(51) Int. Cl.
*F04D 29/66* (2006.01)
*F04D 19/00* (2006.01)
(Continued)

(52) U.S. Cl.
CPC ..... *F04D 29/325* (2013.01); *F04D 19/002* (2013.01); *F04D 29/666* (2013.01); *F04D 29/667* (2013.01); *F24F 1/38* (2013.01)

(58) Field of Classification Search
CPC .... F04D 29/325; F04D 19/002; F04D 29/666; F04D 29/667
See application file for complete search history.

(56) References Cited

U.S. PATENT DOCUMENTS 11,248,623 B2 * 2/2022 Haaf ..... F04D 29/542

FOREIGN PATENT DOCUMENTS

CN 204175641 U 2/2015
CN 107313980 A 11/2017
(Continued)

OTHER PUBLICATIONS

ISR received in PCT/CN2022/087749; mailed Jul. 27, 2022.
(Continued)

*Primary Examiner* — Sabbir Hasan
(74) *Attorney, Agent, or Firm* — K&L Gates LLP

(57) ABSTRACT

The present application discloses an axial flow wind wheel, including a wheel hub and blades; inner edges of the plurality of blades are connected to the wheel hub, and the blades are uniformly arranged at interval in a circumferential direction of the wheel hub; a suction surface of each blade is provided with rows of flow guide structures, and each row of flow guide structure includes flow guide ribs arranged along an arc corresponding thereto; and the arcs respectively corresponding to the rows of flow guide structures are concentric with an axis of the wheel hub, and are arranged
(Continued)

at interval in a radial directional of the wheel hub. An air conditioner outdoor unit includes a heat exchanger, a driving motor, and the axial flow wind wheel.

19 Claims, 7 Drawing Sheets

(51) Int. Cl.
*F04D 29/32* (2006.01)
*F24F 1/38* (2011.01)

(56) References Cited

FOREIGN PATENT DOCUMENTS

| | | | | | |
|---|---|---|---|---|---|
| CN | 207073490 | U | | 3/2018 | |
| CN | 207377862 | U | | 5/2018 | |
| CN | 207961055 | U | | 10/2018 | |
| CN | 208778341 | U | | 4/2019 | |
| CN | 113217462 | A | | 8/2021 | |
| CN | 215860972 | U | | 2/2022 | |
| DE | 102005030444 | A1 | | 2/2006 | |
| FR | 1026366 | A | | 4/1953 | |
| JP | 2001090694 | A | | 4/2001 | |
| JP | 2003161295 | A | | 6/2003 | |
| JP | 2003278696 | A | | 10/2003 | |
| JP | 2008157113 | A | * | 7/2008 | ..... F04D 29/681 |
| JP | 2009068361 | A | | 4/2009 | |
| JP | 2012041821 | A | | 3/2012 | |
| KR | 20130074511 | A | * | 7/2013 | ..... F04D 29/38 |

OTHER PUBLICATIONS

Notice of Allowance received in CN Application No. 202121838268.4; mailed Dec. 6, 2021.
Search Report received in EP Application No. 22854935.8; mailed Sep. 9, 2024.

* cited by examiner

AXIAL FLOW WIND WHEEL, AIR CONDITIONER OUTDOOR UNIT, AND AIR CONDITIONER

CROSS-REFERENCES TO RELATED APPLICATIONS

The present disclosure is a national phase application of International Application No. PCT/CN2022/087749, filed on Apr. 19, 2022, which claims priority to Chinese Patent Application No. 202121838268.4, filed with China National Intellectual Property Administration on Aug. 7, 2021, the entireties of which are herein incorporated by reference.

FIELD

The present application relates to the field of refrigeration devices, and in particular, to an axial flow wind wheel, an air conditioner outdoor unit, and an air conditioner.

BACKGROUND

In an outdoor unit of an air conditioner, an axial flow wind wheel provides air volume required for heat transfer for a heat exchanger of the outdoor unit. The axial flow wind wheel includes a wheel hub and blades arranged along a circumferential direction of the wheel hub. During operation of the axial flow wind wheel, there is a phenomenon of air flow separation on surfaces of the blades, which leads to decrease of air outflow volume of the axial flow wind wheel and increase of operation noise.

SUMMARY

Embodiments of the present application are to provide an axial flow wind wheel, an air conditioner outdoor unit and an air conditioner, which aims to solve the problem that the air outflow volume of the axial flow wind wheel is decreased and the operation noise is increased due to the phenomenon of air flow separation on the surfaces of the blades during operation of the existing axial flow wind wheel.

The axial flow wind wheel provided in the present application includes a wheel hub and blades; the blades are uniformly arranged at interval in a circumferential direction of the wheel hub, inner edges of the blades are connected to the wheel hub; the axial flow wind wheel further includes virtual circumferential lines which are concentric and arranged at interval, and centers of circles of the virtual circumferential lines coincide with an axis of the wheel hub; areas of suction surfaces of the blades corresponding to the virtual circumferential lines are provided with flow guide structures arranged along the virtual circumferential lines.

Beneficial effects of the present application is that the axial flow wind wheel provided in the present application includes a wheel hub and blades uniformly arranged at interval in the circumferential direction of the wheel hub, and the suction surface of each blade is provided with rows of flow guide structures, and each row of flow guide structures includes flow guide ribs and the flow guide ribs are arranged along an arc corresponding thereto; and the arcs corresponding to the rows of flow guide structures are concentric with the axis of the wheel hub, and are arranged at interval in a radial directional of the wheel hub. During rotation of the axial flow wind wheel, the flow guide structures can disperse the air flow separated from the suction surfaces of the blades, and the dispersed air flow is uniformly dispersed, and the dispersed air flow is re-attached to the suction surfaces, to reduce noise of air flow and increase an air supply volume of the wind wheel.

On the basis of the above embodiments, following improvements can be made in the present application.

Further, number of rows of flow guide structures included in the suction surfaces of any two blades is same and the flow guide structures included in the suction surfaces of any two blades are in one-to-one correspondence.

Further, radii of the arcs corresponding to corresponding two rows of flow guide structures are same in the suction surfaces of any two blades.

Further, a row spacing of any adjacent rows of flow guide structures is equal along a radial direction of the wheel hub on the suction surface of a same blade.

Further, the row spacing of adjacent rows of flow guide structures is gradually increased or decreased along the radial direction of the wheel hub on the suction surface of a same blade.

Further, on the suction surface of a same blade and in same row of flow guide structure: a spacing between adjacent flow guide ribs is equal along a direction from a leading edge of the blades to a trailing edge thereof.

Further, on the suction surface of a same blade and in same row of flow guide structure: a spacing between adjacent flow guide ribs is gradually increased or decreased along a direction from a leading edge of the blade to a trailing edge thereof.

Further, lengths of flow guide ribs included in same row of flow guide structure are gradually increased along a direction from an inner edge of the blade to an outer edge thereof.

Further, lengths of the flow guide ribs included in a row of flow guide structure closest to the inner edge of the blade are $\geq D/500$, where D is a diameter of the axial flow wind wheel.

Further, lengths of each flow guide ribs included in a row of flow guide structure closest to the outer edge of the blade are $\leq D/50$, where D is a diameter of the axial flow wind wheel.

Further, the flow guide ribs include one of rectangular flow guide rib, triangular flow guide rib and circular flow guide rib, or a combination thereof.

The present application further provides an air conditioner outdoor unit, including a heat exchanger, a driving motor, and the axial flow wind wheel according to any one of the above solutions, the heat exchanger is arranged opposite to the axial flow wind wheel, and a driving shaft of the driving motor is connected with the wheel hub of the axial flow wind wheel.

The present application further provides an air conditioner, including the above air conditioner outdoor unit.

The beneficial effects of the air conditioner outdoor unit and air conditioner provided in the present application are the same as those of the above axial flow wind wheel, and thus will not be repeated here.

100—wheel hub;

200—blade;

201—inner edge; 202—outer edge; 203—leading edge; 204—trailing edge; 205—suction surface; 206—pressure surface;

300—flow guide structure;

301—flow guide rib;

400—arc.

DETAILED DESCRIPTION OF THE DISCLOSURE

In related technology, in the outdoor unit of the air conditioner, the axial flow wind wheel provides air volume required for heat transfer for the heat exchanger of the outdoor unit. However, because the suction surface of the blade is relatively smooth, there is a phenomenon of air flow separation on the suction surface of the blade during the operation of the axial flow wind wheel, which leads to a decreased air outflow volume of the axial flow wind wheel and increased operation noise.

In view of this, in the embodiments of the present application, there are provided with rows of flow guide structures on the suction surface of each blade, and each row of flow guide structure includes flow guide ribs, and the flow guide ribs are arranged along an arc corresponding thereto; the arcs corresponding to the rows of flow guide structures are concentric with the axis of the wheel hub, and are arranged at interval along the radial direction of the wheel hub. During rotation of the axial flow wind wheel, the flow guide structure can disperse the air flow separated from the suction surface of the blade, and the dispersed air flow is uniformly dispersed and re-attached to the suction surface, to reduce noise of the air flow and increase air supply volume of the wind wheel.

The following will be combined with drawings in the embodiments of the present application to describe the solutions in the embodiments of the present application clearly and completely. The embodiments described are a part of embodiments of the present application, not all embodiments.

Figure 1:
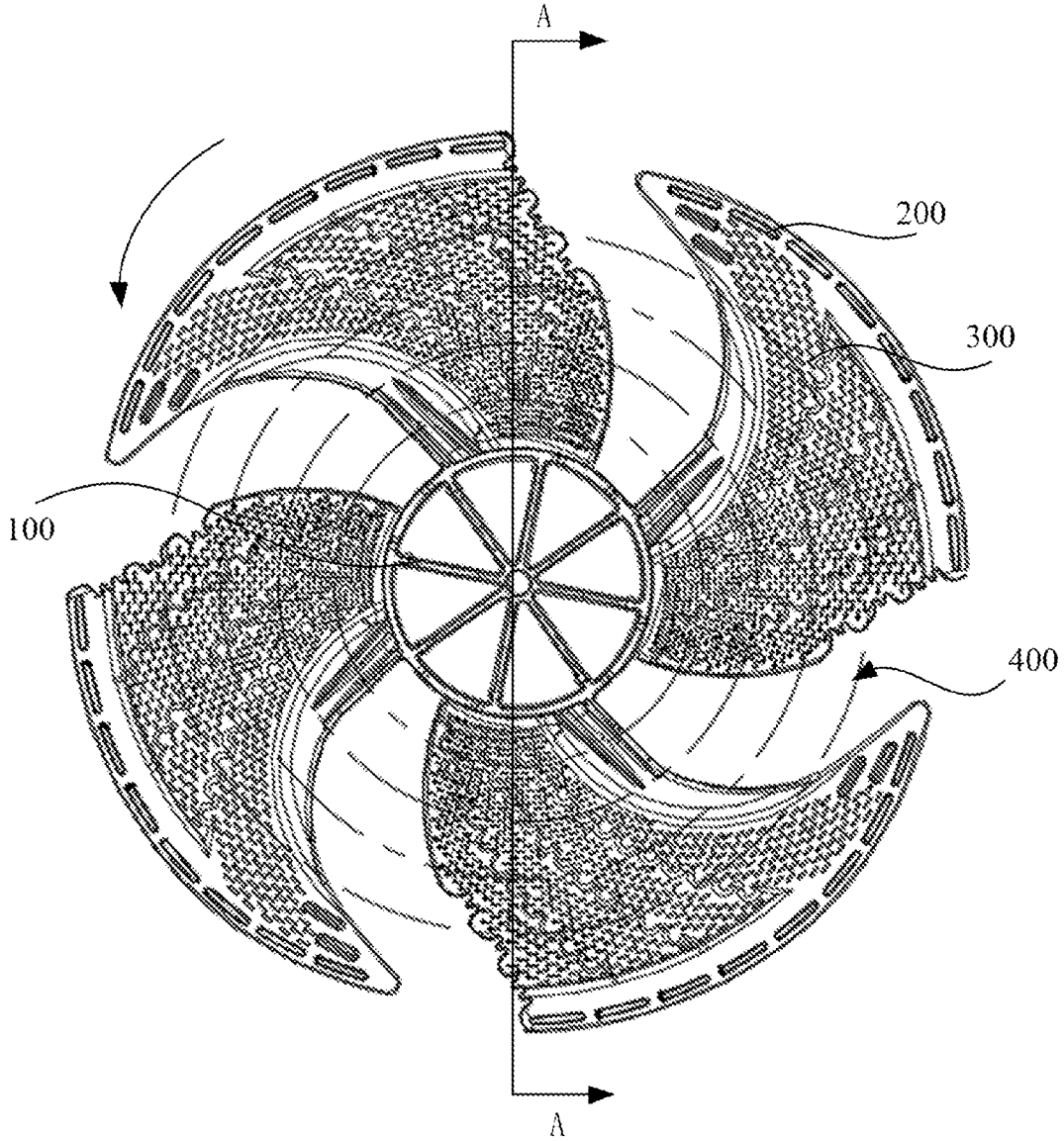
FIG. 1 is a front view of an axial flow wind wheel provided by embodiments of the present application.
Figure 2:
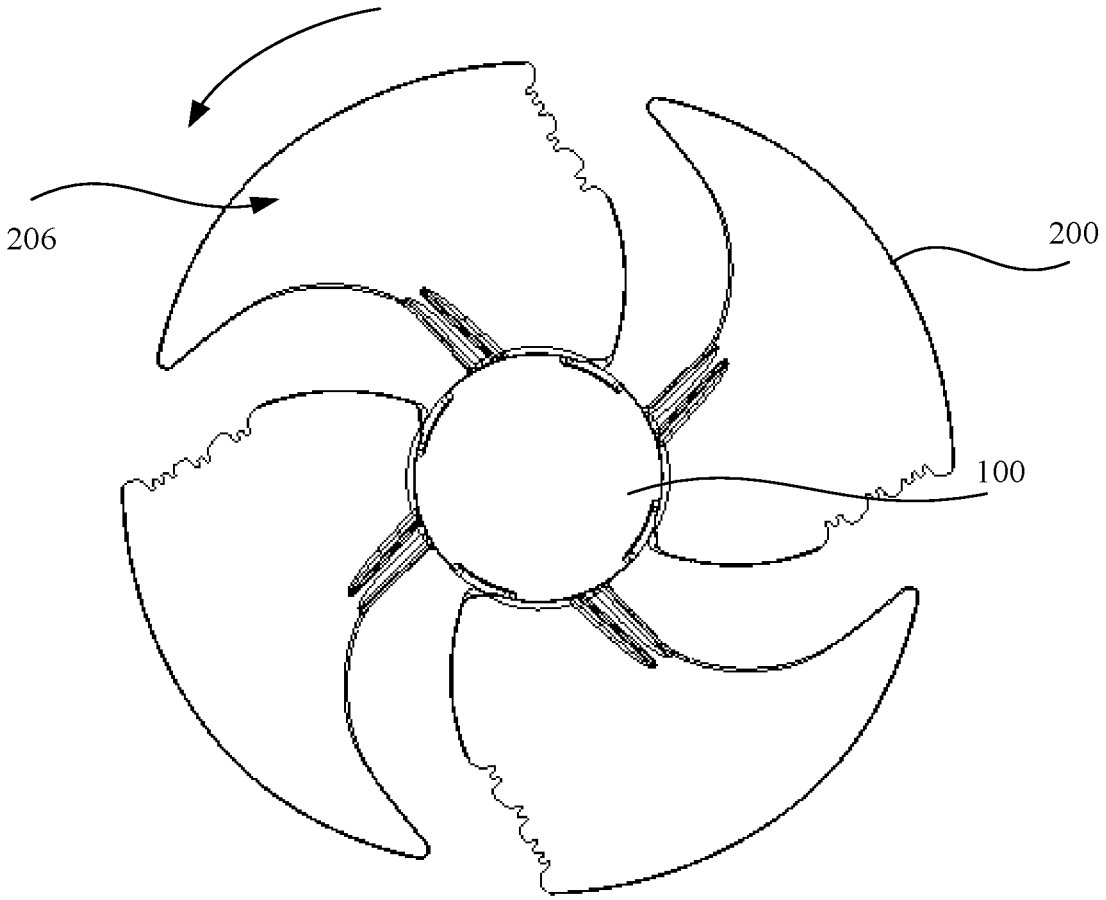
FIG. 2 is a side view of the axial flow wind wheel provided by embodiments of the present application.
Figure 3:
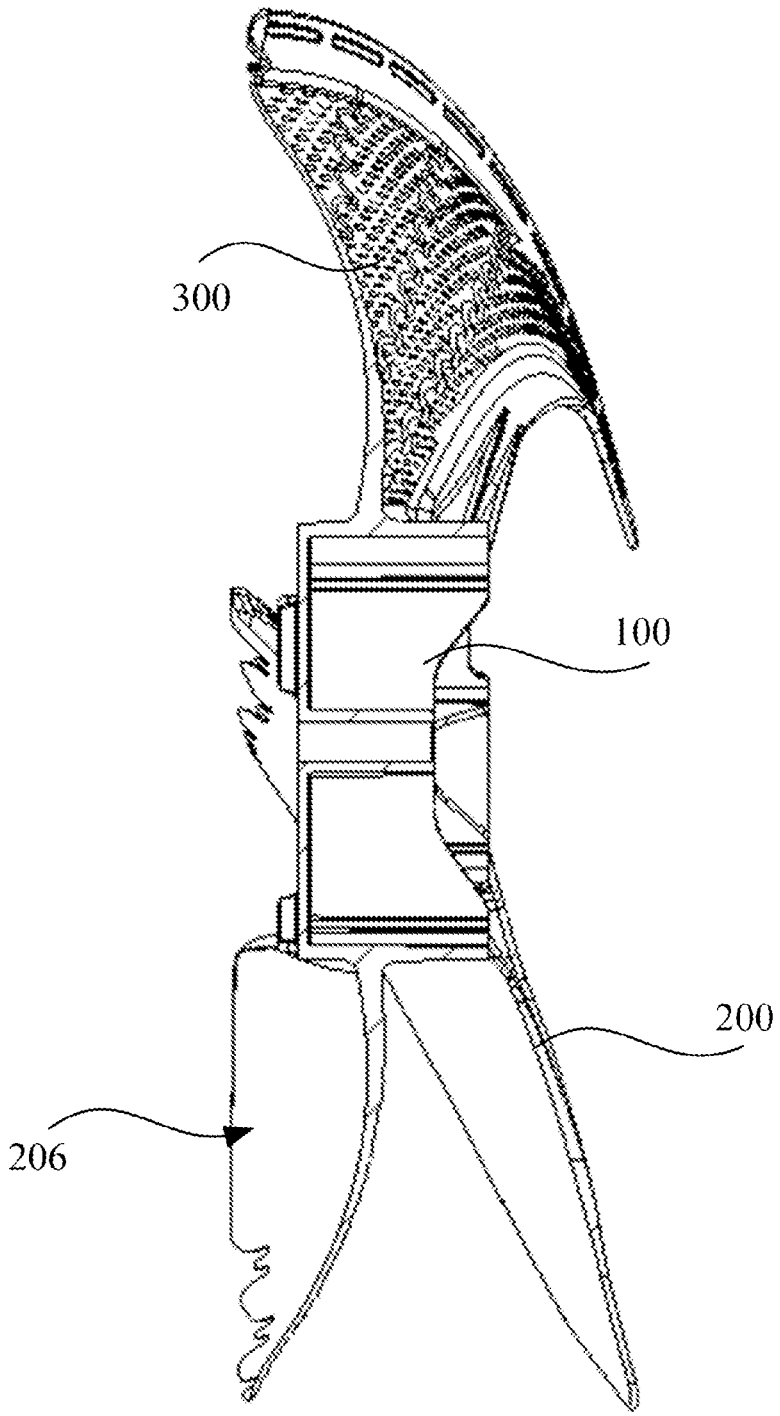
FIG. 3 is a sectional view taken along A-A of FIG. 1.

FIG. 1 is a front view of an axial flow wind wheel provided by embodiments of the present application; FIG. 2 is a side view of the axial flow wind wheel provided by embodiments of the present application; FIG. 3 is a sectional view taken along A-A of FIG. 1.

As shown in FIGS. 1 to 3, the axial flow wind wheel provided by the embodiment of the present application includes a wheel hub 100 and blades 200, where the blades 200 are each arranged on the wheel hub 100, and the wheel hub 100 can drive the blades 200 to rotate under an action of steering force to realize a function of wind supply.

The blades 200 may be uniformly arranged at interval in a circumferential direction of the wheel hub, for example, the axial flow wind wheel may include four blades 200, the four blades 200 surround a central axis of the wheel hub 100 and are arranged at an equal interval on a circumferential wall of the wheel hub 100 in a counterclockwise direction (such as the counterclockwise direction indicated by the arrow shown in FIG. 1).

Each blade 200 includes an inner edge 201, an outer edge 202, a leading edge 203 and a trailing edge 204. Specifically, along a rotation direction (as indicated by the arrow shown in FIG. 1) of the axial flow wind wheel, a front side edge of the blade 200 forms the leading edge 203 of the blade 200, and a rear side edge of the blade 200 forms the trailing edge 204 of the blade 200, and the leading edge 203 and the trailing edge 204 of the blade 200 are arranged opposite to each other.

The outer edge 202 of the blade 200 is formed by an outer side edge connecting the trailing edge 204 and the leading edge 203 in the same blade 200, the inner edge 201 of the blade 200 is formed by an inside side edge connecting the trailing edge 204 and the leading edge 203 in the same blade 200. Among them, the inner edge 201 of the blade 200 is connected with the circumferential wall of the wheel hub 100, the outer edge 202 of the blade 200 extends outward along a diameter direction of the wheel hub 100, and a distance between the outer edge 202 of the blade 200 and the axis of the wheel hub 100 forms a rotation radius of the axial flow wind wheel; and each blade 200 also includes a suction surface 205 and a pressure surface 206 formed on both side surfaces of the wheel hub 100 in an axial direction.

The suction surface of each blade 200 is provided with rows of flow guide structures 300 respectively, and among the rows of flow guide structures 300 arranged on the suction surface of the same blade 200, each row of flow guide structure 300 includes flow guide ribs 301 arranged along a same arc 400; the arc 400 extends in the direction from the leading edge 203 to the trailing edge 204 of the blade 200. The flow guide structures 300 are respectively arranged on different arcs 400, each arc 400 is concentric with the axis of the wheel hub 100, and the arcs 400 are arranged at interval along a radial direction of the wheel hub 100, or the arcs 400 are arranged at interval along a direction of the trailing edge 201 to the leading edge 203 of the blade 200.

In the axial flow wind wheel provided by the embodiment of the present application there is provided with flow guide structures 300 on the suction surface 205 of each blade 200, the flow guide structures 300 are distributed to be concentric with the axis of the wheel hub 100, and arcs 400 are arranged at interval along the radial direction of the wheel hub 100, and each flow guide structure 300 is provided with flow guide ribs 301 on its corresponding arc 400. In this way, the flow guide rib 301 can play a role of disturbing flow during the rotation of the axial flow wind wheel, and can disperse the air flow separated from the suction surface 205, and the air flow after dispersion is uniformly dispersed and re-attached with the suction surface 205, which can reduce noise of the air flow during rotation of the axial flow wind wheel and increase the air supply volume of the axial flow wind wheel.

In one possible embodiment, the axial flow wind wheel includes blades 200 arranged at interval along its circumferential direction, each blade 200 is arranged with rows of flow guide structures 300 along the inner edge 201 and the outer edge 202 of the blade 200. The suction surfaces 205 of any two blades 200 are provided with the same number of rows of flow guide structures 300 in one-to-one correspondence. For example, the axial flow wind wheel may include a first blade and a second blade adjacent to the first blade, and the number of flow guide structures 300 provided on the first blade is the same as the number of flow guide structures 300 provided on the second blade, and the flow guide structures 300 on the first blade may be staggered with the flow guide structures 300 on the second blade.

In another possible embodiment, the number of flow guide structures 300 arranged on the suction surface of the first blade is the same as the number of flow guide structures 300 arranged on the suction surface of the second blade. For one flow guide structure on the first blade and one corresponding flow guide structure on the second blade, arcs 400 corresponding to the two flow guide structures have the same radius, that is, the arcs 400 corresponding to the two corresponding flow guide structures 300 are on a same circle.

On the basis of the above embodiments, the flow guide structure 300 includes flow guide ribs 301 located on the same arc 400. The flow guide ribs 301 provided in the present embodiment can be formed by local bulges on the suction surface 205 of the blade 200, and the flow guide ribs 301 have a thickness, and the thickness is a height of the flow guide ribs 301 along the axial direction of the wheel hub 100. The thicknesses of the flow guide ribs 301 located on the same arc 400 may be the same or different, and if the thicknesses of the flow guide ribs 301 located on the same arc 400 are different, the thicknesses of the flow guide ribs 301 located on the same arc 400 are gradually increased or decreased in a direction from the leading edge 203 to the trailing edge 204 of the blade 200, and this is not limited in the present embodiment and can be set according to the actual needs.

A length direction of the flow guide ribs 301 on the suction surface 205 is the same as an extension direction of the arc 400 on the suction surface 205 of the blade 200, and lengths of the flow guide ribs 301 located on the same arc 400 can be the same or different; this is not limited in the present embodiment and can be set according to the actual needs.

The present embodiment does not restrict the shape of the flow guide ribs 301, for example, the flow guide ribs 301 in the present embodiment may include one of rectangular flow guide ribs 301, triangular flow guide ribs 301, circular flow guide ribs 301 or any combination of the above three. Along the direction from the leading edge 203 to the trailing edge 204 of the blade 200, the extension lengths of the flow guide ribs 301 on the suction surface 205 are projection lengths of the flow guide ribs on respective arcs 400.

For example, if the flow guide ribs 301 are the circular flow guide ribs, their extension lengths on the suction surface 205 in the direction from the leading edge 203 to the trailing edge 204 of the blade 200 are the projection lengths of their diameters on the arc 400. If the flow guide ribs 301 are the triangular flow guide ribs, for example, equilateral triangle guide ribs, their extension lengths on the suction surface 205 in the direction from the leading edge 203 to the trailing edge 204 of the blade 200 are the projection lengths of their side lengths on the arc 400. If the flow guide ribs 301 are the rectangular flow guide ribs, their extension lengths on the suction surface 205 in the direction from the leading edge 203 to the trailing edge 204 of the blade 200 are their projection lengths on the arc 400.

To facilitate the description of the embodiments of the present disclosure are illustrated by an example in which the suction surface 205 is provided with rectangular flow guide ribs, and for flow guide ribs 301 arranged on the same arc 400, the flow guide ribs 301 have a same thickness and the flow guide ribs 301 have a same length on the arc 400.

Figure 4:
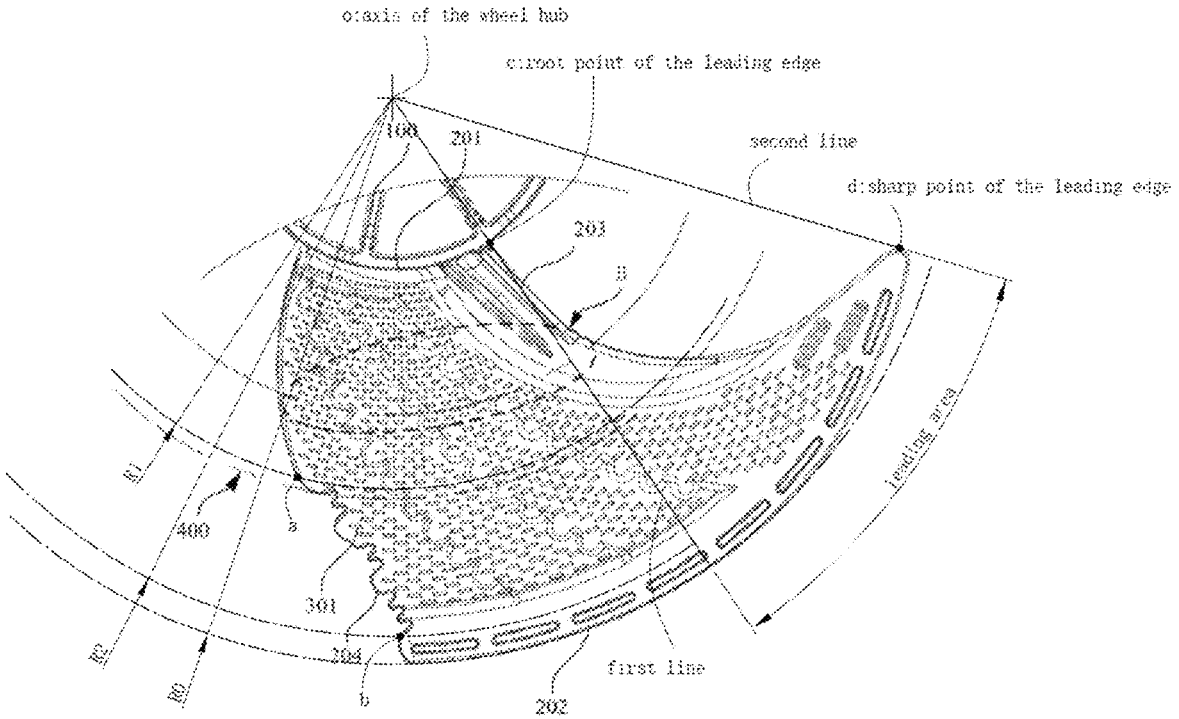
FIG. 4 is a schematic diagram of an arrangement of a flow guide structure in FIG. 1 on a suction surface of the blade.
Figure 5:
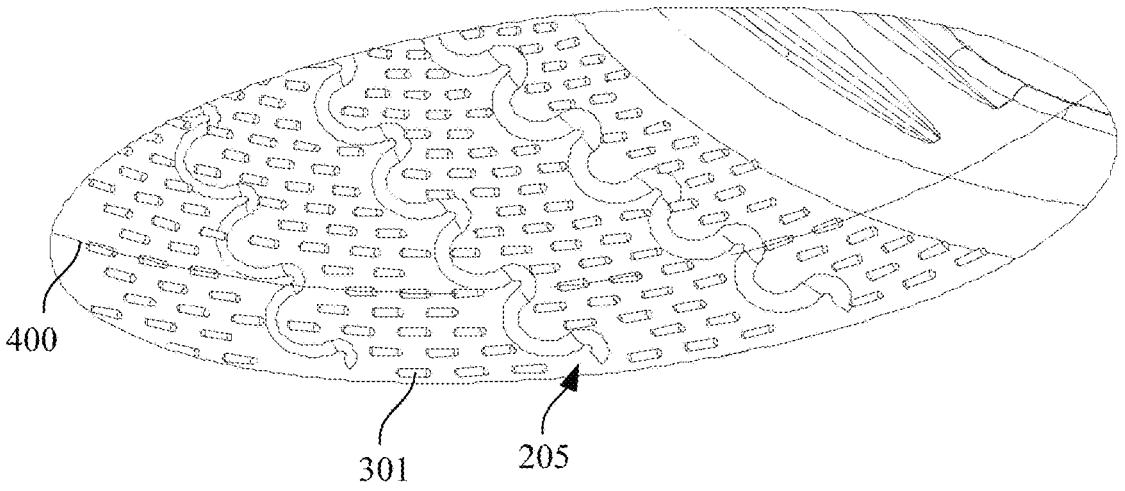
FIG. 5 is an enlarged diagram at B in FIG. 4.

FIG. 4 is a schematic diagram of an arrangement of the flow guide structure in FIG. 1 on the suction surface of the blade; FIG. 5 is an enlarged diagram at B in FIG. 3.

As shown in FIGS. 4 and 5, spacings between adjacent flow guide ribs 301 located on the same arc 400 may be equal in the present embodiment. In other embodiments, the spacings between adjacent flow guide ribs 301 arranged on the suction surface 205 of the same blade 200 and located on the same arc 400 may be unequal.

Figure 6:
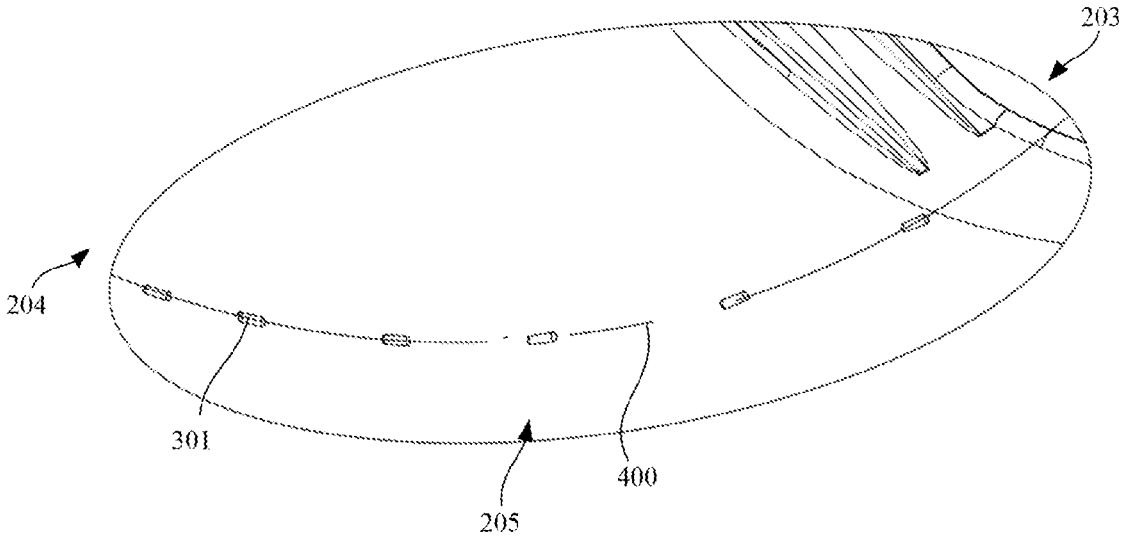
FIG. 6 is a schematic diagram of change of a spacing between flow guide ribs located on a same arc in embodiments of the present application.
Figure 7:
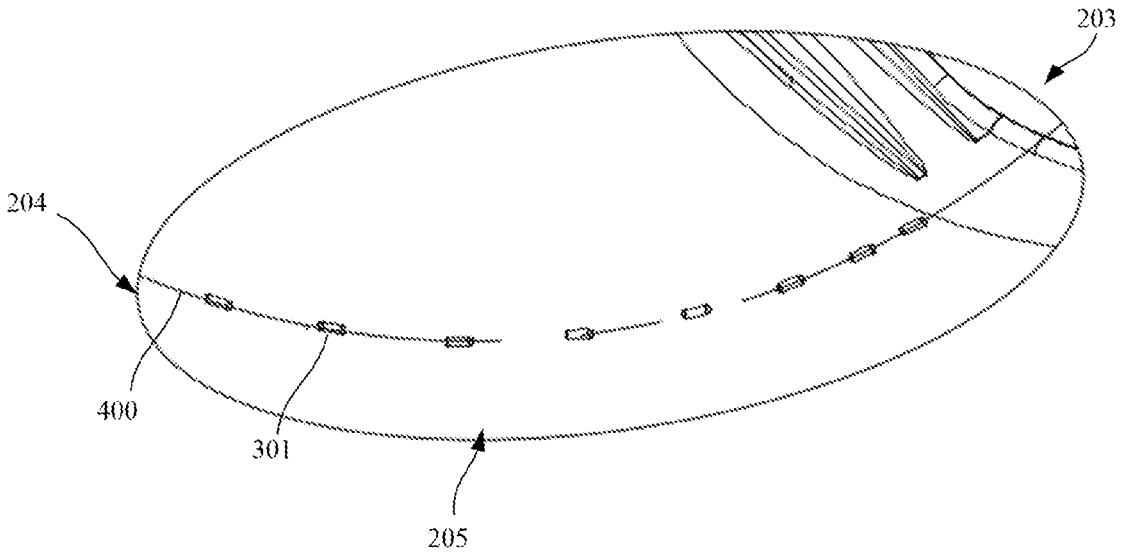
FIG. 7 is another schematic diagram of change of a spacing between flow guide ribs located on a same arc in embodiments of the present application.

FIG. 6 is a schematic diagram of change of a spacing between flow guide ribs located on the same arc 400 in the present embodiment of the present application; FIG. 7 is another schematic diagram of change of the spacing between the flow guide ribs located on the same arc 400 in the present embodiment of the present application.

As shown in FIG. 6, in the present embodiment, on the suction surface of the same blade, the spacings between adjacent flow guide ribs 301 located in the same row are gradually decreased, that is, along the leading edge 203 of the blade 200 to the trailing edge 204 of the blade 200, the spacings between adjacent flow guide ribs 301 located on the same arc 400 are gradually decreased.

As shown in FIG. 7, the present embodiment can also, according to different actual needs, gradually increase the spacings between adjacent flow guide ribs 301 located on the suction surface 205 of the same blade 200 and arranged on the same row; that is, the spacings between adjacent flow guide ribs 301 located on the same arc 400 along the direction from the leading edge 203 of the blade 200 to the trailing edge 204 of the blade 200 are increased gradually, and the present embodiment has no limit on this.

It should be noted that in the present embodiment, in flow guide ribs 301 on the same row, the spacings between adjacent flow guide ribs 301 gradually change in a rule, and satisfy the following equation:

$$S_1 = f * S_2$$

where $S_1$ and $S_2$ are two adjacent spacings; and f is a proportionality coefficient and its value ranges (0.5, 1). The above rule of arrangement applies regardless of whether the flow guide ribs 301 gradually increase or decrease along the direction of the leading edge 203 to trailing edge 204 of the blade 200.

On the basis of the above embodiment, in the present embodiment, along a direction of the inner edge 201 to the outer edge 202 of the blade 200, the rows of flow guide structures are arranged at interval on the suction surface of the blade 200, and the lengths of the flow guide ribs 301 located on different rows are different. For example, the lengths of the flow guide ribs 301 included in the same row of flow guide structure 300 increase gradually along the direction from the inner edge 201 to the outer edge 202 of the blade 200.

Exemplarily, in the present embodiment, the lengths of the flow guide ribs 301 on the arc 400 near the inner edge 201 of the blade 200 are limited; for example, in a row of flow guide structure 300 closest to the inner edge 201 of the blade 200, the length of each flow guide rib 301 included is ≥D/500, where D is the diameter of the axial flow wind wheel. In other embodiments, the length of the flow guide ribs 301 on the arc 400 near the outer edge 201 of the blade 200 are also limited; for example, in a row of flow guide structure 300 closest to the outer edge of the blade 200, the length of each flow guide rib included is ≤50/D, where D is the diameter of the axial flow wind wheel.

In the present embodiment, on the suction surface of the same blade 200, the spacings between adjacent rows of flow guide structures 300 along the radial direction of the wheel hub 100 are equal, that is, along the direction from the inner edge 201 to the outer edge 202 of the blade 200, in the flow guide structures 300 arranged at interval on the suction surface 205 of the blade 200, the spacings between adjacent flow guide structures 300 are equal.

In other embodiments, on the suction surface of the same blade, the spacings between adjacent rows of flow guide structures 300 along the radial direction of the wheel hub 100 are not equal, that is, along the direction from the inner edge 201 to the outer edge 202 of the blade 200, the spacings between adjacent flow guide structures 300 are not equal.

Figure 8:
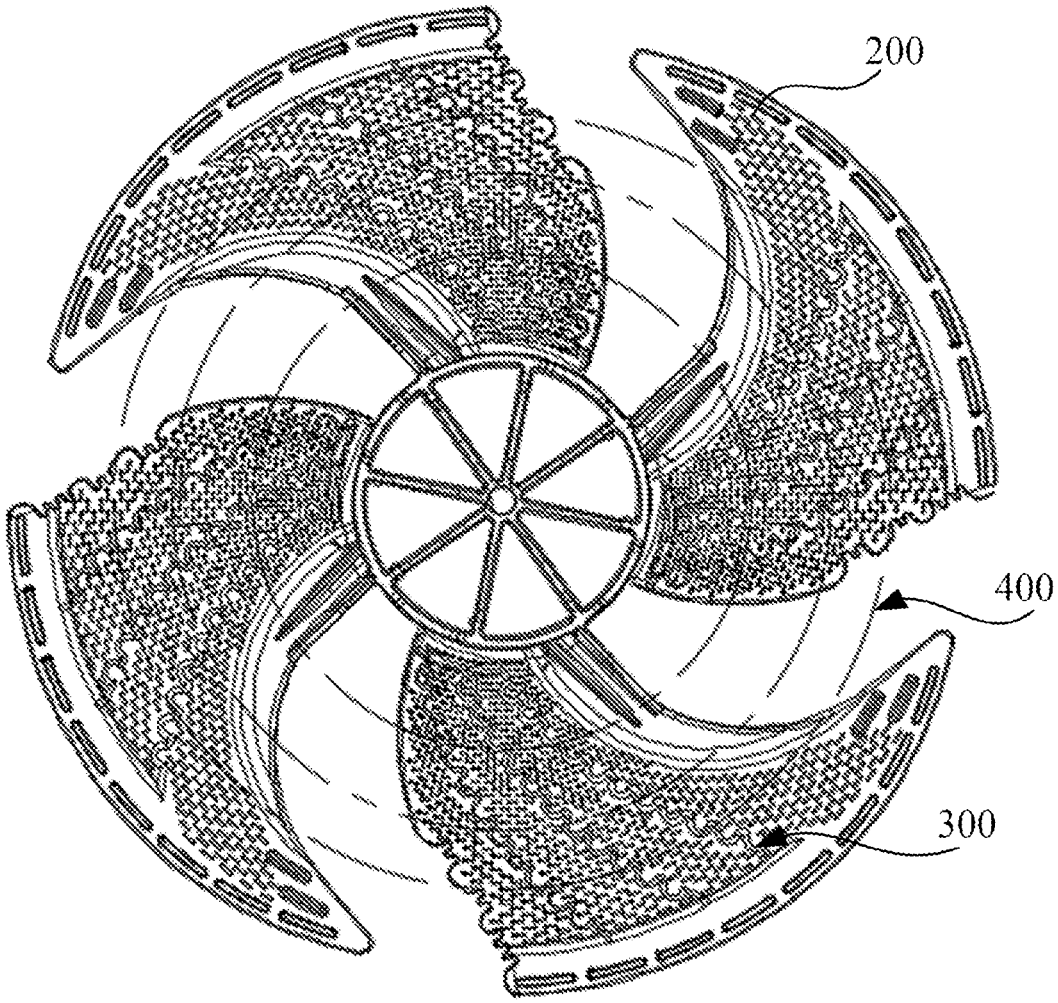
FIG. 8 is a schematic diagram of arcs distributed at an unequal interval in the axial flow wind wheel in embodiments of the present application.
Figure 9:
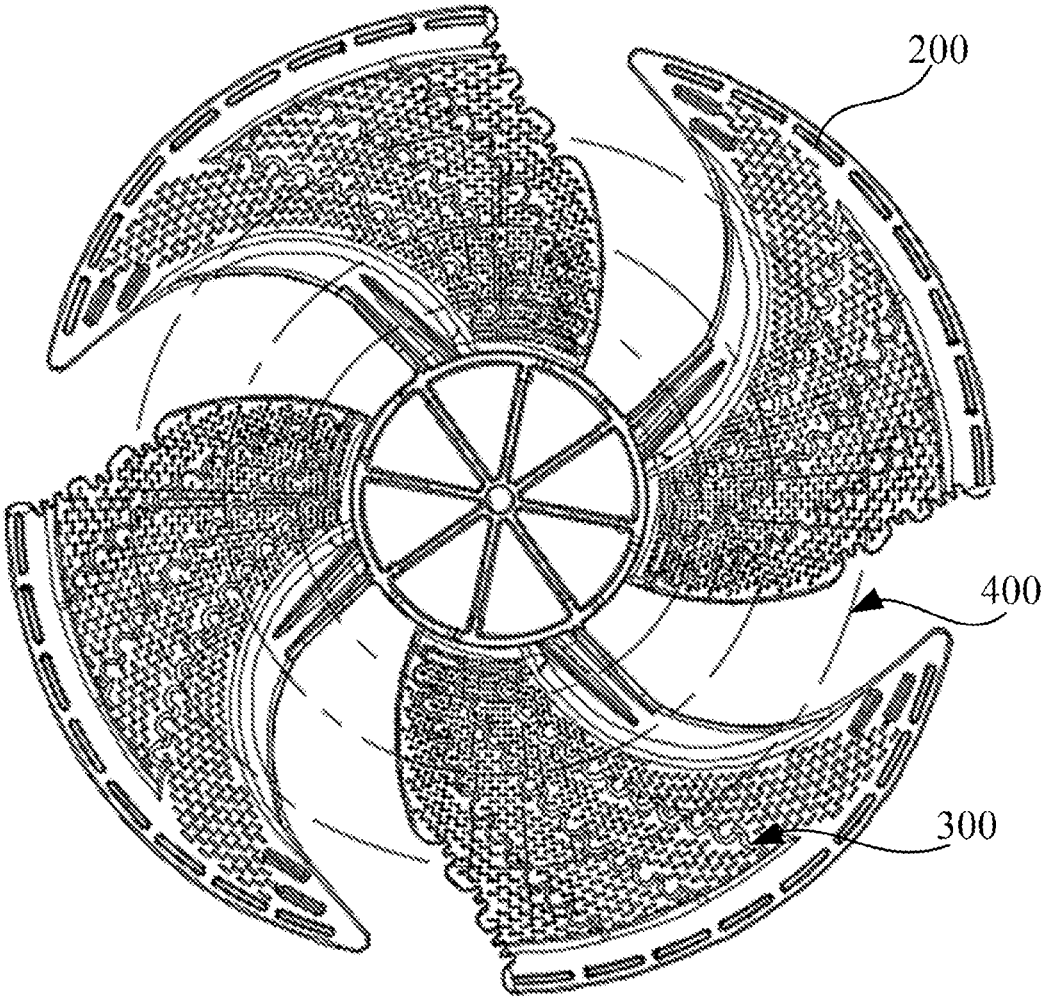
FIG. 9 is another schematic diagram of arcs distributed at an unequal interval in the axial flow wind wheel in embodiments of the present application.

FIG. 8 is a schematic diagram of unequal interval distribution of arcs in the axial flow wind wheel in the present embodiment; FIG. 9 is another schematic diagram of unequal interval distribution of arcs in the axial flow wind wheel in the present embodiment.

As shown in FIG. 8, in flow guide structures 300 located on the suction surface of the same blade 200, row spacings between adjacent rows of flow guide structures 300 can be gradually decreased along the direction from the inner edge 201 to the outer edge 202 of the blade 200. As shown in FIG. 9, in another embodiment, the spacings between adjacent flow guide structures 300 can be gradually increased along the inner edge 201 to the outer edge 202 of the blade 200 according to different actual needs. The present embodiment has no limit on this.

It should be noted that on the suction surface of the same blade 200, the row spacings between two rows of flow guide structures 300 change in a rule and satisfy the following equation: $t_1=f*t_2$, where $t_1$ and $t_2$ are two adjacent row spacings, and f is a proportionality coefficient and its value ranges f (0.5, 1). The above rule of arrangement applies regardless of whether the arcs 400 increase or decrease gradually along the direction from the inner edge 201 to the outer edge 202 of the blade 200.

The embodiment of the present application provides an air conditioner outdoor unit (that is, outdoor unit of air conditioner), including a driving motor, a heat exchanger, and the axial flow wind wheel of embodiments; where a driving shaft of the driving motor is connected with the wheel hub 100 of the axial flow wind wheel, and the axial flow wind wheel is arranged opposite to the heat exchanger, the driving motor drives the axial flow wind wheel to rotate, and the axial flow wind wheel can provide an air volume required for heat exchange of the heat exchanger.

The embodiment of the present application provides an air conditioner, which includes the air conditioner outdoor unit in the embodiments, the outdoor unit including a heat exchanger, and the heat exchanger in the present application may be a microchannel heat exchanger. The microchannel heat exchanger includes at least two sets of microchannels. The at least two sets of microchannels include first microchannels for a first cold medium flow to flow and second microchannels for a second cold medium flow to flow. The second cold medium flow absorbs heat from the first cold medium flow and the first cold medium flow is supercooled, or the first cold medium flow absorbs heat from the second cold medium flow and the second cold medium flow is supercooled.

The microchannel heat exchanger of the embodiment of the present application can also be used as an economizer of the air conditioner. In this way, the microchannel heat exchanger can not only be used to cool electronic components in an electric control box, but also can be used as an economizer, to avoid setting another economizer outside the electric control box, simplifying the structure of the air conditioner, saving space and saving cost.

Since the outdoor unit adopts the solution of the above embodiments, it owns at least all the beneficial effects brought by the solution of the above embodiments, and the effects will not be repeated here.

In the description of the present application, it is to be understood that the orientation or position relationships indicated by the terms such as "center", "length", "width", "thickness", "front", "rear", "inner", "outer", "clockwise", "counterclockwise", "axial", "radial" and "circumferential" are based on the orientation or position relationships shown in the drawings, only to facilitate the description of the present application and simplify the description, rather than indicating or implying that the device or element referred to must have a specific orientation or be constructed and operated in a specific direction, and thus they cannot be understood as a restriction on the present application.

In the present application, unless otherwise expressly specified and limited, a first feature being "above" or "below" a second feature may be a direct contact of the first feature with the second feature, or indirect contact of the first feature with the second feature through an intermediate medium. Moreover, the first feature being "above", "on" and "over" the second feature may be that the first feature is directly above or obliquely above the second feature, or only that a horizontal height of the first feature is higher than that of the second feature. The first feature being "under", "below" and "lower" the second feature may be that the first feature is directly below or obliquely below the second feature, or simply that the horizontal height of the first feature is less than that of the second feature.

In the description of the present specification, the description with the reference to the terms "one embodiment", "some embodiments", "example", "specific example", or "some examples" means that the specific features, structures, materials or characteristic described in combination with the embodiment or example are included in at least one embodiment or example of the present application. In the present specification, the schematic descriptions of the above terms do not have to be directed to the same embodiment or example. Furthermore the specific features, structures, materials or characteristics described may be combined in an appropriate manner in any one or more embodiments or examples.

Although the embodiments of the present application have been shown and described above, it is understood that the above embodiments are exemplary and cannot be understood as restrictions on the present application.

Embodiments are only used to explain the principles of the present application and are not intended to limit the scope of protection of the present application. For example, although the air conditioner inner unit of the present application is described in conjunction with a wall-mounted air-conditioner inner unit, but this is not a limitation. Air conditioner inner unit of other equipment can also be equipped with the air conditioner inner unit of the present application, such as cabinet-type air conditioner inner unit.

Secondly, it should be noted that in the description of the present application, the terms "inner", "outer", etc., indicating the direction or position relationship are based on the direction or position relationship shown in the drawings, which is only for the purpose of convenient description, rather than indicating or implying that the device or component must have a specific orientation, be constructed and operated in a particular direction, and therefore cannot be understood as a restriction on the present application.

The invention claimed is:

1. An axial flow wind wheel, comprising a wheel hub and a plurality of blades; wherein inner edges of the plurality of blades are connected to the wheel hub, and the plurality of blades are uniformly arranged at interval in a circumferential direction of the wheel hub;

a suction surface of each blade of the plurality of blades is provided with a plurality of rows of flow guide structures, and each row of flow guide structure comprises a plurality of flow guide ribs arranged along an arc corresponding thereto; and arcs respectively corresponding to the rows of flow guide structures are concentric with an axis of the wheel hub, and are arranged at interval in a radial directional of the wheel hub;

two rows of the respective flow guide ribs along two adjacent arcs are arranged at interval and staggered in a radial directional of the wheel hub.

2. The axial flow wind wheel according to claim 1, wherein the suction surfaces of any two blades comprise a same number of rows of flow guide structures, which are in one-to-one correspondence.

3. The axial flow wind wheel according to claim 2, wherein the arcs corresponding to corresponding two rows of flow guide structures have a same radius in the suction surfaces of the any two blades.

4. The axial flow wind wheel according to claim 3, wherein on the suction surface of a same blade and in a same row of a respective flow guide structure:

spacings between adjacent flow guide ribs are equal along a direction from a leading edge to a trailing edge of the blade.

5. The axial flow wind wheel according to claim 3, wherein on the suction surface of a same blade and in a same row of a respective flow guide structure:

spacings between adjacent flow guide ribs are gradually increased or decreased along a direction from a leading edge to a trailing edge of the blade.

6. The axial flow wind wheel according to claim 2, wherein on the suction surface of a same blade and in a same row of a respective flow guide structure:

spacings between adjacent flow guide ribs are equal along a direction from a leading edge to a trailing edge of the blade.

7. The axial flow wind wheel according to claim 2, wherein on the suction surface of a same blade and in a same row of a respective flow guide structure:

spacings between adjacent flow guide ribs are gradually increased or decreased along a direction from a leading edge to a trailing edge of the blade.

8. The axial flow wind wheel according to claim 1, wherein row spacings of any adjacent rows of the respective flow guide structures are equal along the radial direction of the wheel hub on the suction surface of a same blade.

9. The axial flow wind wheel according to claim 1, wherein row spacings of adjacent rows of the respective flow guide structures are gradually increased or decreased along the radial direction of the wheel hub on the suction surface of a same blade.

10. The axial flow wind wheel according to claim 9, wherein on the suction surface of a same blade and in a same row of the respective flow guide structures:

spacings between adjacent flow guide ribs are equal along a direction from a leading edge to a trailing edge of the same blade.

11. The axial flow wind wheel according to claim 10, wherein lengths of the flow guide ribs comprised in the same row of the respective flow guide structures are gradually increased along a direction from an inner edge to outer edge of the blade.

12. The axial flow wind wheel according to claim 11, wherein the lengths of the flow guide ribs comprised in a row of flow guide structures closest to the inner edge of the blade are $\geq D/500$, wherein D is a diameter of the axial flow wind wheel.

13. The axial flow wind wheel according to claim 11, wherein the lengths of the flow guide ribs comprised in a row of flow guide structures closest to the outer edge of the blade are $\leq D/50$, wherein D is a diameter of the axial flow wind wheel.

14. The axial flow wind wheel according to claim 1, wherein on the suction surface of a same blade and in a same row of the respective flow guide structures:

spacings between adjacent flow guide ribs are gradually increased or decreased along a direction from a leading edge to a trailing edge of the blade.

15. The axial flow wind wheel according to claim 1, wherein the flow guide ribs comprise one of rectangular flow guide rib, triangular flow guide rib and circular flow guide rib, or a combination thereof.

16. The axial flow wind wheel according to claim 1, wherein on each blade of the plurality of blades, along a rotation direction of the axial flow wind wheel, a front side edge of the blade forms a leading edge, and a rear side edge of the blade forms a trailing edge, and the leading edge and the trailing edge are arranged opposite to each other;

a jagged edge is provided at the trailing edge, starting from radius R1 and ending at radius R2 at the trailing edge, R1 and R2 are radius from the axis of the wheel hub, and R2 is lager than R1; and several rows of the respective flow guide structures are arranged from R1 to R2, and two rows of flow guide ribs along two adjacent arcs are arranged at interval and staggered in the radial directional of the wheel hub.

17. The axial flow wind wheel according to claim 16, wherein on each blade of the plurality of blades, an outer edge of the blade is formed by an outer side edge connecting the trailing edge and the leading edge in the same blade, the inner edge of the blade is formed by an inside side edge connecting the trailing edge and the leading edge in the same blade, and the outer edge of the blade extends outward along a diameter direction of the wheel hub; and a radius of the out edge from the axis of the wheel hub is R0, and $50\% R0 \leq R1 < R2 \leq 90\% R0$.

18. The axial flow wind wheel according to claim 17, wherein the flow guide ribs closest to the outer edge of the blade are only located in a leading area, the leading area is a part of the blade surrounded by a first line connecting the axis of the wheel hub and a root point of the leading edge, and a second line connecting the axis of the wheel hub and a sharp point of the leading edge.

19. The axial flow wind wheel according to claim 18, wherein two rows of the respective flow guide ribs closest to the outer edge of the blade are only located in the leading area, are arranged at interval and staggered in the radial directional of the wheel hub.

* * * * *